US010189695B2

(12) United States Patent
Brinkworth

(10) Patent No.: US 10,189,695 B2
(45) Date of Patent: Jan. 29, 2019

(54) KEG COVER

(71) Applicant: Kevin Matthew Brinkworth, Buffalo, NY (US)

(72) Inventor: Kevin Matthew Brinkworth, Buffalo, NY (US)

( * ) Notice: Subject to any disclaimer, the term of this patent is extended or adjusted under 35 U.S.C. 154(b) by 74 days.

(21) Appl. No.: 15/416,399

(22) Filed: Jan. 26, 2017

(65) Prior Publication Data

US 2018/0208360 A1 Jul. 26, 2018

(51) Int. Cl.

*B67D 1/14* (2006.01)
*B65D 21/02* (2006.01)
*B67D 1/08* (2006.01)

(52) U.S. Cl.

CPC ..... *B67D 1/1477* (2013.01); *B65D 21/0224* (2013.01); *B67D 1/0801* (2013.01); *B67D 1/0877* (2013.01); *B67D 2001/0822* (2013.01)

(58) Field of Classification Search

CPC .. B65D 2543/0074; B65D 2543/00027; F25D 2331/802; F25D 3/08; B67D 1/0801
See application file for complete search history.

(56) References Cited

U.S. PATENT DOCUMENTS 4,705,188 A 11/1987 Rahn
D327,604 S 7/1992 Culverson
D331,349 S 12/1992 Culverson
5,224,678 A 7/1993 McClellan
5,251,460 A * 10/1993 DeMarco ..... B65D 81/3886 220/592.19
5,425,454 A * 6/1995 Przytulla ..... B65D 1/16 206/508
5,657,871 A 8/1997 Waters et al.
5,875,915 A * 3/1999 Bradshaw ..... B65D 43/0218 206/508
7,850,019 B2 12/2010 Muth
8,720,738 B1 5/2014 Ryman
8,967,407 B2 * 3/2015 Apps ..... B65D 11/06 220/4.05
9,359,100 B2 * 6/2016 Smith ..... B65D 1/0223
9,475,607 B2 * 10/2016 Apps ..... B65D 11/06
9,568,236 B1 * 2/2017 Laskowski ..... F25D 3/08
9,617,140 B2 4/2017 Hershberger
(Continued)

FOREIGN PATENT DOCUMENTS

EP 0757002 B1 5/2005
JP 09175544 A 7/1997
(Continued)

OTHER PUBLICATIONS

PCT Written Opinion of the International Searching Authority for PCT/US2018/013986 dated May 24, 2018.

*Primary Examiner* — Shawn M Braden
(74) *Attorney, Agent, or Firm* — Rogowski Law LLC

(57) ABSTRACT

A keg cover removably joins to a top rim of a keg and covers the bung and the entirety of the top surface of the keg. When installed, the keg cover protects the top surface of the keg from contamination, and provides a stable stacking surface so that a second keg may be safely stacked on top of the keg to which the keg cover is joined. The keg cover further creates one or more storage spaces between the top surface of the keg and the keg cover to hold tap handles and other desired items.

24 Claims, 4 Drawing Sheets

(56) References Cited

U.S. PATENT DOCUMENTS

| | | | | |
|---|---|---|---|---|
| 2005/0269338 | A1* | 12/2005 | Oliveira | F17C 1/04 220/737 |
| 2009/0044561 | A1* | 2/2009 | Dalton | B67D 1/06 62/398 |
| 2016/0162831 | A1 | 6/2016 | Hershberger | |

FOREIGN PATENT DOCUMENTS

| | | | |
|---|---|---|---|
| JP | 2008302553 | A | 12/2008 |
| WO | 2018140268 | A1 | 8/2018 |

* cited by examiner

KEG COVER

BACKGROUND OF THE INVENTION

The present invention is generally directed to stacking devices and covers for beer kegs, and more particularly to covers to install onto a keg over the entire top surface of the keg, including over the keg opening or bung, to keep the top surface clean and facilitate vertical stacking of kegs.

Draft beer is sold by brewers and distributors in kegs. A keg generally is a stainless steel or aluminum barrel-shaped container that holds liquid contents, such as beer, under pressure. An opening at one end of the keg, also called the bung, houses a self-closing valve. The valve may be opened by a coupling fitting when the keg is tapped. An upstanding rim extends from the outer wall and around the bung. The top of the rim may be rolled to form a curved top edge. Hand grips are formed in the sidewalls of the rim, such as oval shaped openings spaced apart from the top of the rim, by which the top of the keg may be lifted for moving the keg from one location to another.

Sometimes the top of the keg bung may be covered with a cap to protect the valve during transit and storage before the keg is tapped. See, e.g., U.S. Pat. No. 4,705,188. However, no means is provided to protect the entire top surface of the keg from contaminants.

Beer brewers often have stylized tap handles that may be used in conjunction with dispensing their particular beer from their beer kegs. Some breweries require bar and restaurant owners to pay a deposit fee for the tap handle to be used to dispense the beer from an individual keg, and to return the tap handle upon returning the emptied keg. Invariably, the tap handles are separated from the kegs. No means is provided to keep the tap handle together with the beer keg when the kegs are in transit or stored prior to tapping.

Bars and restaurants frequently lack sufficient storage space for multiple beer kegs. When kegs are stored on their rounded sides, they can be unstable and roll. When kegs are stored in upright position, it can be difficult to stack them one on top the other due to the combination of a dished top surface that angles downwardly from the bung with the raised hand grip rim at the outer periphery. The keg tops lack flat surfaces conducive to stacking. Notwithstanding these limitations, bar and restaurant staff often try to stack kegs to fit them within the limited storage space available, creating hazards.

Some attachments for kegs to permit stacking are known. See, e.g., U.S. Pat. D327,604; D331,349; U.S. Pat. Nos. 5,224,678 and 6,657,871. None of these cover the entire top surfaces of the keg to prevent contamination or solve the problem of keeping tap handles together with their associated kegs.

Therefore, improvements to keg covers continue to be sought.

BRIEF SUMMARY OF THE INVENTION

Briefly stated, one aspect of the present invention is a keg cover that has a structure adapted for removable joinder to a top rim of a keg, said structure having a top surface and a bottom surface opposite from the top surface, and defining a center. A depending rim is spaced radially apart from the center and extends axially downwardly from the top surface of the structure. The depending rim defines a curved channel adapted to removably engage the top rim of the keg. For example, the curved channel may be removably snap fit to the top rim of the keg. The structure when joined to the rim of the keg preferably covers the entire top surface of the keg.

At least one notch is formed in the depending rim of the keg cover structure. The structure also has a sidewall section extending axially downwardly from the top surface at the at least one notch. The sidewall section terminates with a radially outwardly extending tongue. At least one tab extends radially outwardly from the depending rim. The at least one notch is positioned for alignment with a hand grip formed in the top rim of the keg when the structure is joined to the top rim of the keg. The structure may have a generally circular top surface from which the depending rim extends.

The keg cover structure may have a second notch in the depending rim, which second notch is spaced apart from the at least one notch. Where there is a second notch, there is a second sidewall section extending axially downwardly from the top surface of the structure at the second notch, with the second sidewall section terminating with a radially outwardly extending second tongue.

In one advantageous embodiment, the keg cover structure further includes a tube-shaped channel extending axially downwardly from the bottom surface of the structure. The tube-shaped channel is adapted to receive or engage a bung of the keg. In this embodiment, one or more ribs may extend radially inward from an inner surface of the tube-shaped channel. The one or more ribs have a length in the axial direction, which length is shorter than the length of the tube-shaped channel. In such embodiment, the one or more ribs are adapted to contact a top surface of the bung of the keg or a cap on the bung of the keg.

In addition, the keg cover structure may further include one or more ribs extending axially downwardly from the bottom surface of the structure. The ribs reinforce the center portion of the structure. When the keg cover is joined to a keg, the bottom surface of the structure is spaced apart from a top surface of the keg to define at least one storage space between the bottom surface of the structure and the top surface of the keg. If the ribs extending axially downwardly from the bottom surface of the structure are present, the ribs create partition spaces or compartments of storage space between the bottom surface of the structure and the top surface of the keg.

In another advantageous embodiment of the invention, the top surface of the keg cover structure is concavely dished. In still another advantageous embodiment of the invention, indicia is printed or embossed on the keg cover structure, such as on the top surface or sidewall section of the structure. The keg cover structure may be a single unitary molded part. The keg cover structure may be molded of material in one or more colors to coordinate the structure color with identification of the liquid content within the keg.

In yet another advantageous embodiment of the invention, a radio frequency identification chip is embedded into or applied to the keg cover structure.

A further aspect of the present invention is a keg and tap handle delivery system that includes a combination of a keg, a tap handle and a keg cover, wherein the keg cover has the structure and features as noted herein. When the keg cover is joined to the keg, the bottom surface of the keg cover structure is spaced apart from a top surface of the keg to define at least one storage space between the bottom surface of the structure and the top surface of the keg. That at least one storage space is adapted to hold the tap handle for transport and storage. The at least one storage space may be adapted to hold other items in addition to the tap handle. The keg and tap handle delivery system may have a keg cover structure with indicia printed or embossed on the top surface or sidewall section of the structure. In addition, the keg cover structure may include a radio frequency identification chip embedded into or applied to the structure. The keg cover structure may be molded of material in one or more colors to coordinate the structure color with identification of liquid content within the keg.

Still another aspect of the present invention is a method of stacking two kegs. In such method, a keg cover having the structure and features noted herein is engaged to a rim of a first keg. Then, a second keg is placed onto the top surface of the keg cover structure, with a bottom surface of the second keg in contact with the top surface of the keg cover structure.

BRIEF DESCRIPTION OF THE DRAWINGS

The foregoing summary, as well as the following detailed description of the disclosure, will be better understood when read in conjunction with the appended drawings. For the purpose of illustrating the disclosure, there is shown in the drawings an embodiment of a headrest which is presently preferred. It should be understood, however, that the disclosure is not limited to the precise arrangements and instrumentalities shown. In the drawings.

DESCRIPTION OF THE DISCLOSURE

Figure 1:
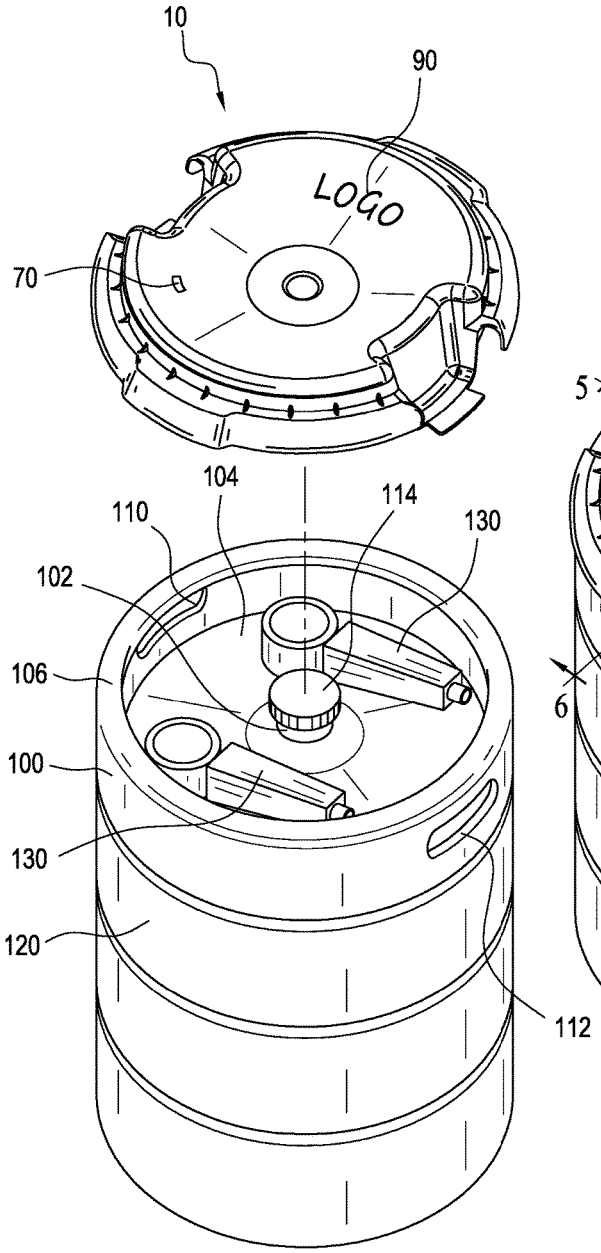
FIG. 1 is an exploded right front perspective view of a keg cover according to the invention and a beer keg, with two keg tap handles laying on the top surface of the beer keg.

Certain terminology is used in the following description for convenience only and is not limiting. The words "lower," "bottom," "upper," "top," "right" and "left" designate directions in the drawings to which reference is made. The words "inwardly," "outwardly," "upwardly" and "downwardly" refer to directions toward and away from, respectively, the geometric center of the headrest, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It also should be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to the drawings in detail, wherein like numerals indicate like elements throughout, there is shown in FIGS. 1-6, a keg cover 10 that is a structure with a generally round periphery and defining a center 11. The structure has a top surface 12 and a bottom surface 14 opposite from the top surface, and a sidewall 22. A portion 16 of the top surface is concavely dished.

A depending rim 18 forms the outer periphery of the structure, and depends downwardly from the sidewall 22. The depending rim 18 is spaced apart radially from the center 11. The depending rim 18 has a top surface 28 and opposite from its top surface 28 defines a curved channel 20 directed downwardly or axially. In use, the channel 20 of the depending rim 18 is adapted to receive a rim 106 that is upstanding from a top surface 104 of a keg 100.

At least one gap is formed in the sidewall 22 and in the depending rim 18. As shown in the embodiment in FIGS. 3 and 4, there are two gaps in the sidewall 22 and depending rim 18 at which a first notch 24 and a second notch 26, respectively, are formed. The first notch 24 has a sidewall 30 that extends downwardly from the top surface 12 and terminates in a tongue 36. The second notch 26 has a sidewall 32 that extends downwardly from the top surface 12 and terminates in a tongue 38. Tongues 36, 38 are directed radially outwardly away from the center 11 of the structure. In use, the first notch 24 and second notch 26 are registered with handle openings 110, 112 respectively of a keg 100 when the keg cover 10 is installed onto a keg 100. See FIGS. 2 and 5. The first notch 24 and second notch 26 define spaces to receive a person's fingers when the person grips the handle openings 110, 112 of the keg 100, while the keg cover 10 is installed over the top surface 104 of the keg 100. The tongues 36, 38 extend into the handle openings 110, 112 and may have their outer tips in contact with lower rim surfaces of the handle openings 110, 112.

Figure 4:
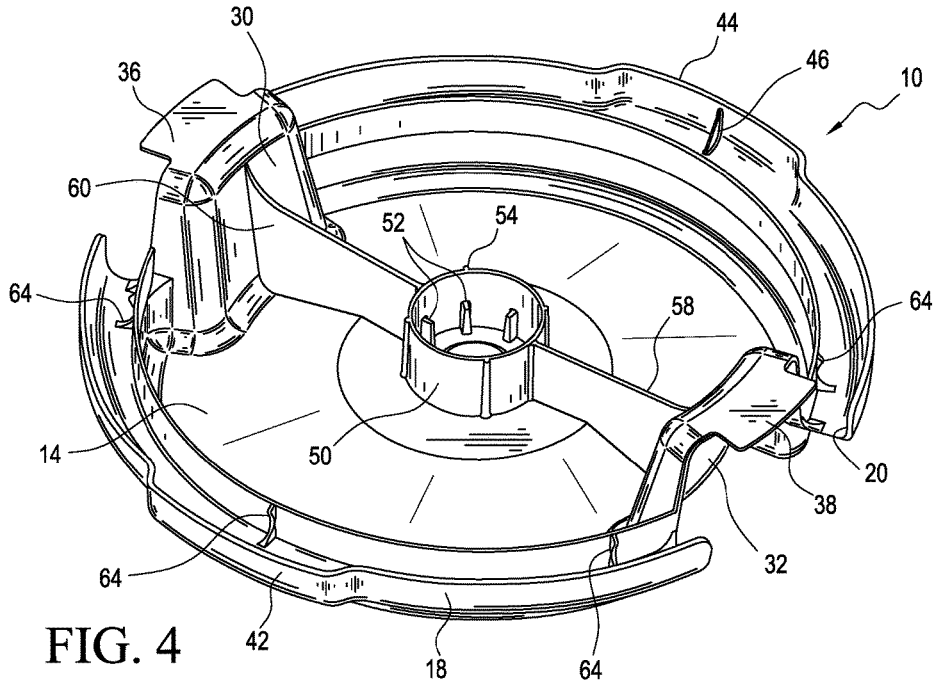
FIG. 4 is a bottom rear perspective view of the keg cover of FIG. 3.
Figure 5:
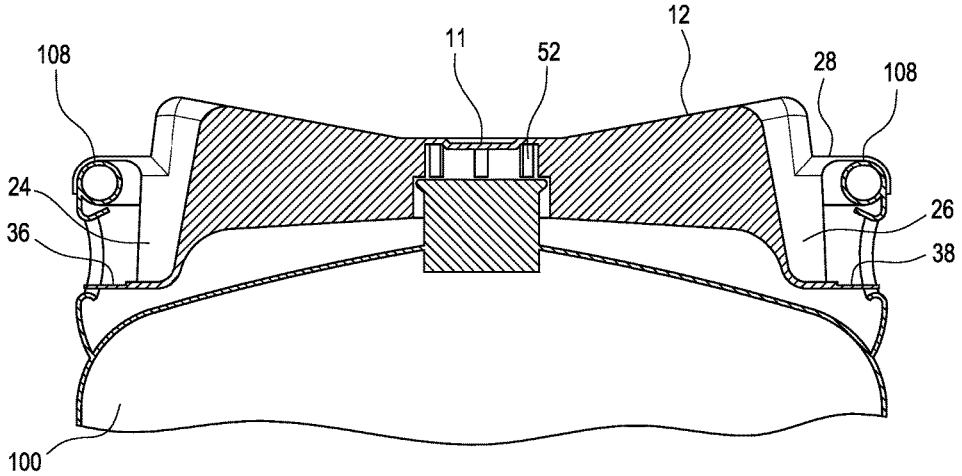
FIG. 5 is a cross-sectional view of the keg cover taken along line 5-5 of FIG. 2.

One or more tabs 42, 44 may be formed in the depending rim 18. The tabs 42, 44 extend outwardly a greater radial distance from the center 11. The tabs 42, 44 form handles by which a user may grip the keg cover 10 when installing the keg cover 10 onto the turned rim edge 108 of a keg 100. When the keg cover 10 is installed onto a keg 100, the tabs 42, 44 also provide gripping locations spaced apart from the turned rim edge 108 of the keg 100 to permit lifting or bending of the keg cover 10 to remove the keg cover 10 from the keg 100. Reinforcing vertical ribs or vanes 48 may be molded to the top surface 28 of the depending rim to strengthen the connection between the sidewall 22 and top surface 28 of the depending rim 18. As shown in FIG. 4, the bottom surface of the tabs 42, 44 may be reinforced by ribs or vanes 46, and the curved channel 20 may be reinforced by ribs or vanes 64.

As shown in FIG. 4, a tube-shaped channel 50 extends axially outwardly and downwardly from the bottom surface 14 of the keg cover 10. The tube-shaped channel 50 is located at or near the center 11 of the keg cover 10 and is adapted to receive or engage the bung 102 of the keg 100 when the keg cover is installed onto a keg 100. The tube-shaped channel 50 defines an inner wall and an outer wall opposite from the inner wall. A series of ribs or vanes 52 project radially inwardly from the inner wall into the tube-shaped channel 50. A series of ribs or vanes 54 project radially outwardly from the outer wall of the tube-shaped channel 50.

Optionally, and preferably, additional reinforcing ribs or vanes 58, 60 are provided to strengthen the keg cover 10. Reinforcing rib or vane 58 projects downwardly from the bottom surface 14 and extends radially from the outer wall of the tube-shaped channel 50 to the sidewall 32 of the notch 26. Reinforcing rib or vane 60 projects downwardly from the bottom surface 14 and extends radially from the outer wall of the tube-shaped channel 50 to the sidewall 30 of the notch 24. When present, the vanes 58, 60 effectively create two chambers of storage space 80 between the bottom surface 14 of the keg cover 10 and the top surface 104 of a keg 100 to which the keg cover 10 is attached. When the reinforcing vanes 58, 60 are not present, one chamber of storage space 80 still is created between the bottom surface 14 of the keg cover 10 and the top surface 104 of a keg 100 to which the keg cover 10 is attached.

Figure 2:
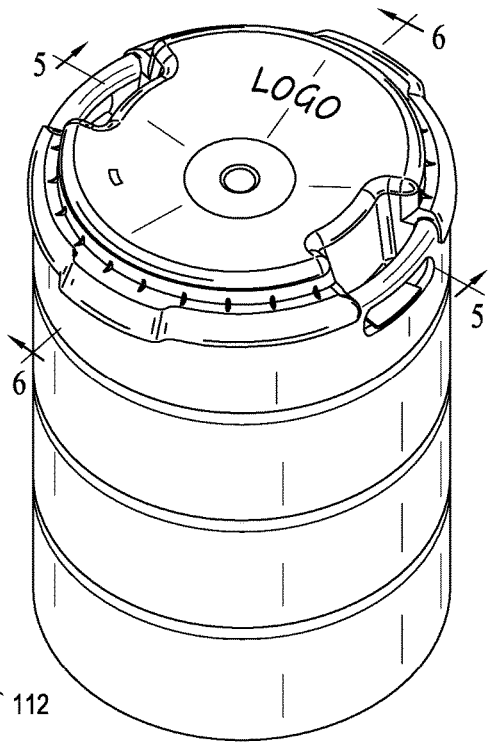
FIG. 2 is a right front perspective view of the keg cover according to the invention joined to the top of the beer keg.
Figure 3:
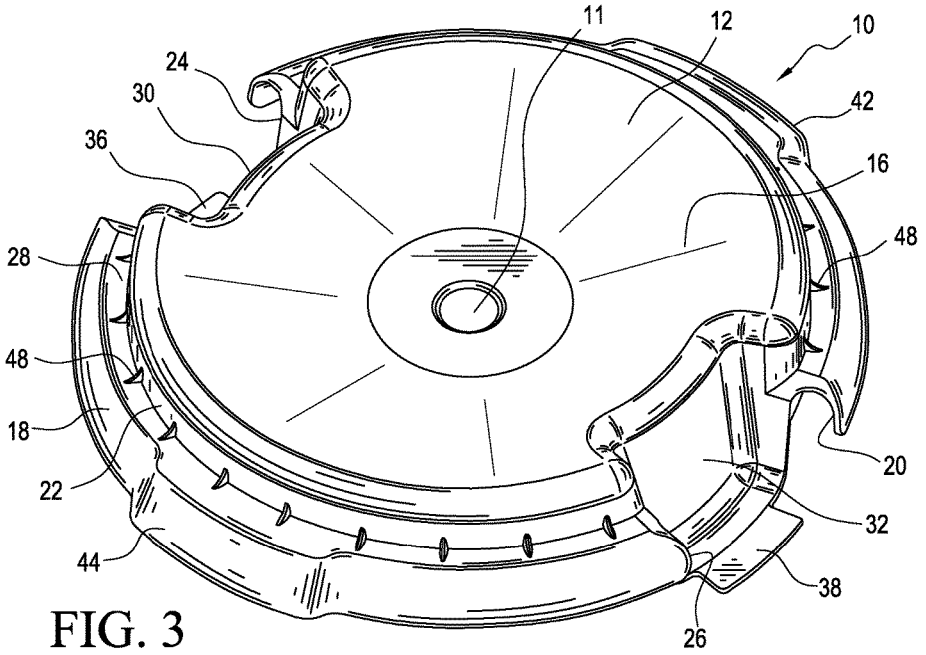
FIG. 3 is a right front perspective view of a keg cover according to the invention.

Referring to FIGS. 1 and 2, it is shown that once it is installed, the keg cover 10 covers the entire top surface 104 of the keg 100, keeping the top surface 104 and bung 102 and bung cap 114 protected from contaminants and debris. The keg cover 10 thus improves sanitary storage conditions for a keg 10 prior to tapping.

Referring to FIGS. 1 and 2, a keg 100 is a barrel most often formed of stainless steel with a curved sidewall 120 and a bottom surface 118 opposite from the top surface 104. The keg 100 generally has a bung 102 extending from its top surface 104 that includes a self-closing valve (not shown) which is adapted to receive a tap handle 130 or a connection leading to a tap handle 130 when dispensing the keg contents, such as beer. The bung 102 may be covered by a cap 114. A tube called a spear (not shown) extends inside the keg from the bung opening to the other end of the keg barrel. An upstanding rim 106 extends upwardly from the top surface 104, and has a turned rim edge 108. Generally handle openings 110, 112 are formed in the upstanding rim 106 at opposite sides of the top surface 104 to facilitate gapping the keg 100 for transport. The top surface 104 may be shaped or convexly dished away from the center and away from the bung 102. The bottom surface 118 may be shaped or convexly dished away from the outer periphery of the bottom surface. There usually is a bottom rim 122 extending from the bottom of the keg 100 (see FIG. 8).

Figure 7:
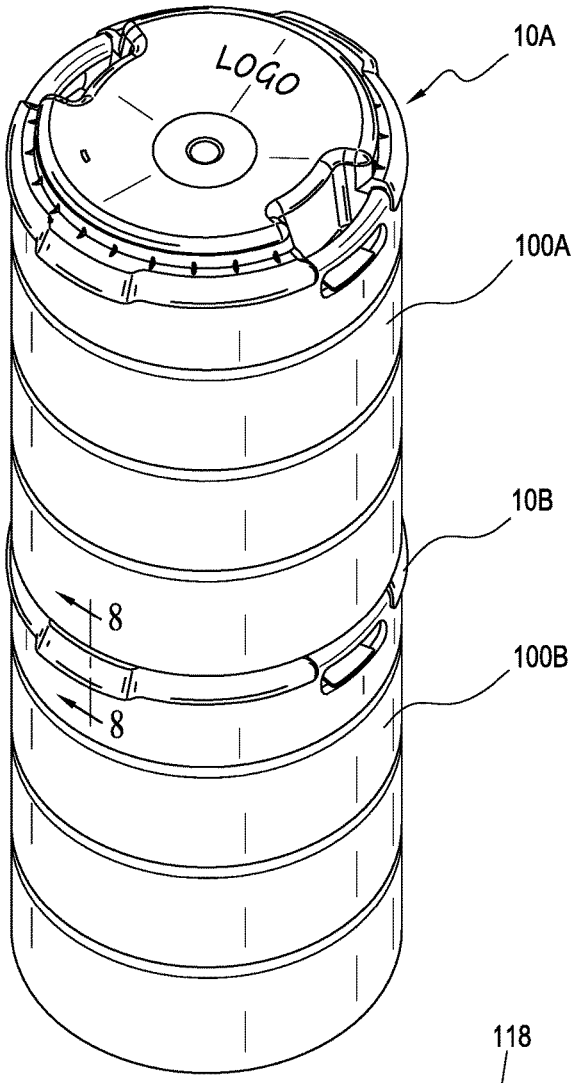
FIG. 7 is a right front perspective view of two kegs each covered with keg covers according to the invention, wherein a second keg is vertically stacked onto the keg cover that is covering the first keg.
Figure 8:
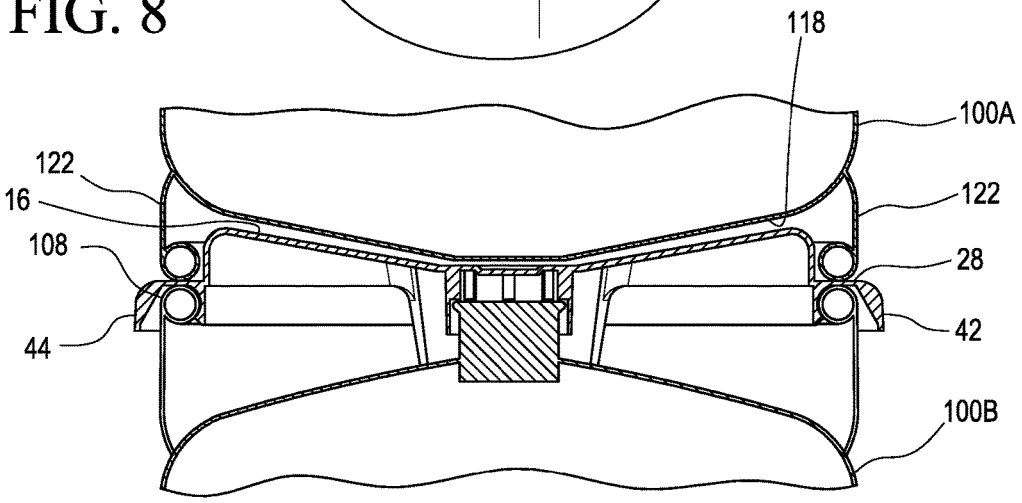
FIG. 8 is a partial cross-sectional view of the first keg, first keg cover and second keg taken along line 8-8 of FIG. 7.

Referring to FIGS. 7 and 8, it is shown that the keg cover 10 enables stable stacking of one keg 100A over a second keg 100B. The keg cover 10 is installed over the top surface 104 of keg 100B, and second keg 100A is then stacked on top of the keg cover 10 and keg 100B. The outer rim 122 of the bottom of the second keg 100A contacts the annular top surface 28 of the depending rim 18. The bottom surface of the second keg 100A preferably mates with the dished portion 16 of the top surface 12 of the keg cover 10B to increase stability of the stacked connection.

Figure 6:
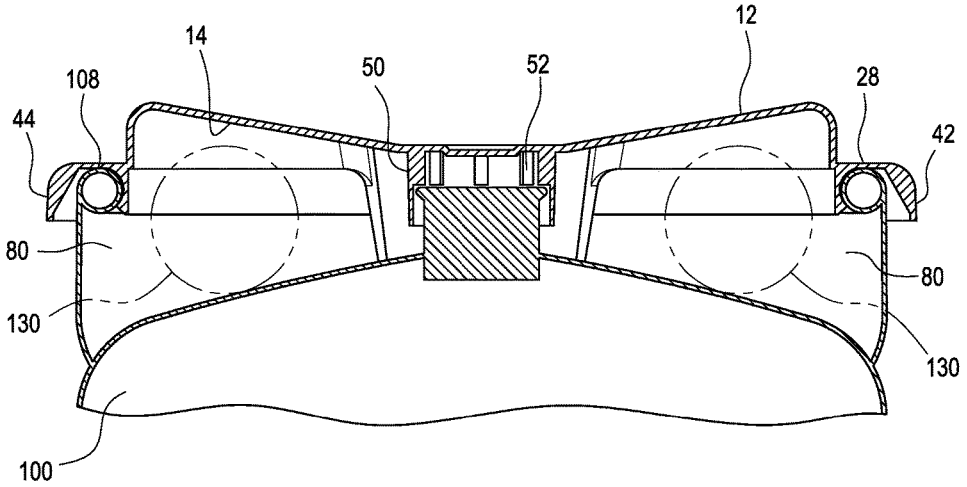
FIG. 6 is a cross-sectional view of the keg cover taken along line 6-6 of FIG. 2.

In one particularly advantageous embodiment, the keg cover 10 together with the keg 100 creates a keg and tap handle delivery system. As shown in FIGS. 1 and 6, one or more tap handles 130 may be placed on the top surface 104 of the keg 100. The keg cover 10 then is attached to turned rim edge 108 of the upstanding rim 106 of the keg 100. The tap handle(s) 130 are held within the storage space(s) 80 created between the keg cover 10 and the top surface 104 of the keg 10. In this manner, a brewery or distributor may secure tap handle(s) 130 for delivery together with the keg 10 containing the beer or other beverage produced by the brewery and stored in the keg. The brewery may better track the tap handle(s) 130 as the tap handle(s) are delivered in combination with the keg 10. In addition to or instead of tap handle(s) 130, other items also could be placed in the storage space(s) 80 for delivery to a customer, including, but not limited to, advertising swag, advertising materials, catalogs, t-shirts, glassware, containers of sample beers, such as in cans or bottles, replacement parts, and/or spare keg tap parts.

Because the keg cover 10 is removably attachable to a keg 100, the keg cover 10 can be re-used. This offers the advantage that the keg cover 10 may be installed on a first keg 100A, and selectively removed and installed on a second keg 100B as desired. Breweries or distributors generally require that an empty keg 100 be returned, together with a tap handle 130 or other provided items, in order to receive credit or refund for a deposit. The keg cover 10 facilitates this return. If the keg cover 10 is installed over the keg 100 to be returned, the tap handle 130 also may be placed in the storage space 80 created between the top surface of the empty keg 100 and the keg cover 10. Thus, it will be much easier for customers to keep tap handles 130 together with kegs 100 for storage and return.

Preferably, the keg cover 10 is molded from a thermoplastic material, such as polyethylene or foamed polyethylene or polypropylene or other thermosetting plastics.

If formed of a moldable material, the keg cover 10 may be embossed or molded to include identification or advertising indicia 90, such as the "LOGO" shown in FIGS. 1 and 2. For example, identification or advertising indicia may be embossed or molded on the top surface 12 and/or sidewall 22 and/or sidewalls 30, 32, and/or depending rim 18. In addition, the keg cover 10 may be molded of materials with one or more added colorants to create different commercial impressions or for advertising.

In another embodiment, a radio frequency identification (RFID) chip 70 may be embedded within the material forming the keg cover 10 or may be appended to the keg cover 10, such as with an adhesive (not shown), to facilitate inventory tracking of the keg 100, the keg cover 10 and the tap handle(s) 130 supplied to a customer.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

I claim:

1. A keg cover for removable joinder to a keg, comprising:

a structure adapted for removable joinder to a top rim of the keg, said structure having a top surface and a bottom surface opposite from the top surface, and defining a center;

a depending rim spaced radially apart from the center and extending axially downwardly from the top surface of the structure, said depending rim defining a curved channel adapted to removably engage the top rim of the keg;

at least one notch in the depending rim;

a sidewall section extending axially downwardly from the top surface of the structure at the at least one notch, said sidewall section terminating with a radially outwardly extending tongue; and at least one tab extending radially outwardly from the depending rim;

wherein the at least one notch is positioned for alignment with a hand grip formed in the top rim of the keg when the structure is joined to the top rim of the keg.

2. The keg cover of claim 1, further comprising a second notch in the depending rim, spaced apart from the at least one notch, and a second sidewall section extending axially downwardly from the top surface of the structure at the second notch, said second sidewall section terminating with a radially outwardly extending second tongue.

3. The keg cover of claim 1, wherein the structure has a generally circular top surface from which the depending rim extends.

4. The keg cover of claim 1, further comprising a tube-shaped channel extending axially downwardly from the bottom surface of the structure, said tube-shaped channel being adapted to engage at least a portion of a bung of the keg or a cap on the bung of the keg.

5. The keg cover of claim 4, further comprising one or more ribs extending radially inwardly from an inner surface of the tube-shaped channel.

6. The keg cover of claim 5, wherein the tube-shaped channel has a length in the axial direction, and the one or more ribs have a second length in the axial direction that is shorter than the length of the tube-shaped channel.

7. The keg cover of claim 6, wherein the one or more ribs are adapted to contact a top surface of the bung of the keg.

8. The keg cover of claim 4, further comprising one or more ribs extending axially downwardly from the bottom surface of the structure.

9. The keg cover of claim 1, wherein when the cover is joined to the keg, said bottom surface of the structure is spaced apart from a top surface of the keg to define at least one storage space between the bottom surface of the structure and the top surface of the keg.

10. The keg cover of claim 1, wherein the curved channel is adapted for snap fitting to the rim of the keg.

11. The keg cover of claim 1, wherein the structure when joined to the rim of the keg covers substantially the entire top surface of the keg.

12. The keg cover of claim 1, wherein the cover is formed of a material selected from the group consisting of: polyethylene, foamed polyethylene, polypropylene, and other thermosetting polymers.

13. The keg cover of claim 1, wherein the top surface of the structure is concavely dished.

14. The keg cover of claim 1, further comprising indicia printed or embossed on the structure.

15. The keg cover of claim 1, further comprising indicia printed or embossed on the top surface or sidewall section of the structure.

16. The keg cover of claim 1, further comprising a radio frequency identification chip embedded into or applied to the structure.

17. The keg cover of claim 1, wherein the structure is a single unitary molded part.

18. The keg cover of claim 17, wherein the structure is molded of material in one or more colors to correlate with identification of liquid content within the keg.

19. A keg and tap handle delivery system, comprising:

a keg;

a tap handle; and a keg cover according to claim 1 removably attachable to the keg;

wherein when the cover is joined to the keg, said bottom surface of the structure is spaced apart from a top surface of the keg to define at least one storage space between the bottom surface of the structure and the top surface of the keg adapted to hold the tap handle for transport and storage.

20. The keg and tap handle delivery system of claim 19, further comprising indicia printed or embossed on the top surface or sidewall section of the structure.

21. The keg and tap handle delivery system of claim 19, further comprising a radio frequency identification chip embedded into or applied to the structure.

22. The keg and tap handle delivery system of claim 19, wherein the structure is molded of material in one or more colors to correlate with identification of liquid content within the keg.

23. The keg and tap handle delivery system of claim 19, further comprising other items in addition to the tap handle held in the at least one storage space.

24. A method of stacking two kegs, comprising:

a. engaging a keg cover to a rim of a first keg, the keg cover comprising: a structure adapted for removable joinder to a top rim of the first keg, said structure having a top surface and a bottom surface opposite from the top surface, and defining a center, a depending rim spaced radially apart from the center and extending axially downwardly from the top surface of the structure, said depending rim defining a curved channel adapted to removably engage the top rim of the first keg, at least one notch in the depending rim, a sidewall section extending axially downwardly from the top surface of the structure at the at least one notch, said sidewall section terminating with a radially outwardly extending tongue, and at least one tab extending radially outwardly from the depending rim, wherein the at least one notch is positioned for alignment with a hand grip formed in the top rim of the first keg when the structure is joined to the top rim of the first keg; and b. placing a second keg onto the top surface of the structure, with a bottom surface of the second keg or a bottom rim of the second keg in contact with the top surface of the structure or top portion of the depending rim of the structure.

* * * * *